US005843601A

United States Patent [19]

Yoon

[11] Patent Number: 5,843,601

[45] Date of Patent: Dec. 1, 1998

[54] HIGH-LUMINANCE-LOW-TEMPERATURE MASK FOR CRTS AND FABRICATION OF A SCREEN USING THE MASK

[75] Inventor: Sang Youl Yoon, Kyungsangbuk-do, Rep. of Korea

[73] Assignee: Orion Electric Co., Ltd., Kyungsangbuk-do, Rep. of Korea

[21] Appl. No.: 817,598

[22] PCT Filed: Aug. 5, 1996

[86] PCT No.: PCT/KR96/00129

§ 371 Date: Mar. 31, 1997

§ 102(e) Date: Mar. 31, 1997

[87] PCT Pub. No.: WO97/06551

PCT Pub. Date: Feb. 20, 1997

[30] Foreign Application Priority Data

Aug. 4, 1995 [KR] Rep. of Korea ..... 1995-20103
Aug. 4, 1995 [KR] Rep. of Korea ..... 1995-24025

[51] Int. Cl.[6] ..... G03C 5/00

[52] U.S. Cl. ..... 430/23; 430/26

[58] Field of Search ..... 430/23, 26

[56] References Cited

U.S. PATENT DOCUMENTS

| | | | |
|---|---|---|---|
| 3,956,526 | 5/1976 | Ohshima et al. | 427/160 |
| 5,229,234 | 7/1993 | Riddle et al. | 430/28 |
| 5,240,798 | 8/1993 | Ebemann | 430/23 |

FOREIGN PATENT DOCUMENTS

| | | |
|---|---|---|
| 0081329 | 12/1981 | European Pat. Off. . |
| 0064319 | 11/1982 | European Pat. Off. . |
| 0378911 | 7/1990 | European Pat. Off. . |

*Primary Examiner*—Roland Martin
*Attorney, Agent, or Firm*—Notaro & Michalos P.C.

[57] ABSTRACT

Disclosed are a shadow mask, a cathode ray tube having the above shadow mask and a method for manufacturing a screen using the shadow mask. The shadow mask can concentrate electron beams and thereby largely increase luminance even with low electric power without deteriorating the purity of colors. The shadow mask has a first and a second thin metal plates. A first and a second voltages are applied to the first and the second thin metal plates and concentrate the electron beams passing through the first and the second electron beam passing holes respectively formed in the metal plates. The screen is manufactured with a controlled size of a developed area by controlling time using the shadow mask and an electrophotographical process.

5 Claims, 8 Drawing Sheets

34
32
18

36
34
32
18

38
40
16a
16
34
32
18

18
32
34
42

R.G.B
(21)
34
32
18

HIGH-LUMINANCE-LOW-TEMPERATURE MASK FOR CRTS AND FABRICATION OF A SCREEN USING THE MASK

BACKGROUND OF THE INVENTION

The present invention relates to a shadow mask of a cathode ray tube, and more particularly to a shadow mask, a cathode ray tube having the shadow mask and a method for manufacturing a screen using the shadow mask, in which electron beams are concentrated during the passing through electron passing holes of the shadow mask.

Referring to FIG. 1, a color cathode-ray tube (CRT) 10 generally comprises an evacuated glass envelope consisting of a panel 12, a funnel 13 sealed to the panel 12 and a tubular neck 14 connected by the funnel 13, an electron gun 11 centrally mounted within the neck 14 and a shadow mask or a color selection electrode 16 removably mounted to a sidewall of the panel 12. A three color phosphor screen 20 is formed on the inner surface of a display window or faceplate 18 of the panel 12.

The electron gun 11 generates three electron beams 19*a* or 19*b*, said beams being directed along convergent paths through the shadow mask 16 to the screen 20 by means of several lenses of the gun and accelerated by a high potential applied through an anode button 15 and being deflected by a deflection yoke 17, so as to scan over the screen 20 through apertures or slits 16*a* formed in the shadow mask 16.

In the color CRT 10, the phosphor screen 20, as shown in FIGS. 2A and 2B, comprises an array of three phosphor elements R, G and B of three different emission colors arranged in a cyclic order of a predetermined structure of multiple-stripe or multiple-dot shape and a matrix of light-absorptive material surrounding the fluorescent elements or the phosphor elements R, G and B.

An aluminum thin film 22 which is an electroconductive film overlies the screen 20 in order to provide a means for applying the uniform potential to the screen 20. The aluminum thin film 22 increases the brightness of the phosphor screen and prevents the phosphor screen from being burned due to ions and the potential of the phosphor screen from decreasing. And also, a film of resin such as lacquer(not shown) may be applied between the aluminum thin film 22 and the phosphor screen 20 to enhance the flatness and reflectivity of the aluminum thin film 22.

In a wet photolithographic process, which is well known as a prior art process for forming the phosphor screen, a slurry of a photosensitive binder and phosphor particles is coated on the inner surface of the faceplate. It does not meet the higher resolution demands and requires a lot of complicated processing steps and a lot of manufacturing equipments, thereby necessitating a high cost in manufacturing the phosphor screen. And also, it discharges a large quantity of effluent such as waste water, phosphor elements, 6th chrome sensitizer, etc., with the use of a large quantity of clean water.

To solve or alleviate the above problems of the wet photolithographic process, an eletrophotographical process for manufacturing the phosphor screen has been developed. The eletrophotographical process can be also classified as a wet-type and a dry-type, of which the dry eletrophotographical process utilizing dry-powdered phosphor particles fairly overcomes the above problems while the wet eletrophotographical process cannot.

U.S. Pat. No. 4,921,767, issued to Datta at al. on May 1, 1990, describes one dry-type method of electrophotographically manufacturing the phosphor screen assembly, as shown in FIGS. 3A to 3E and as is briefly explained in the following.

Prior to the screen process, the panel 12 is washed by various methods. Thereafter, a conductive layer 32, as shown in FIG. 3A, is formed by conventionally coating the inner surface of the viewing faceplate 18 with a suitable conductive solution comprising an electrically conductive material which provides an electrode for an overlying photoconductive layer 34. The conductive layer 32 can be an inorganic conductive material such as tin oxide or indium oxide, or their mixture or, preferably, a volatilizable organic conductive material consisting of a polyelectrolyte commercially known as polybrene(1,5-dimethyl-1,5-diazaundecamethylene polymethobromide, hexadimethrine bromide), available from Aldrich Chemical Co., Milwaukee Wis., or another quaternary ammonium salt. The polybrene is conventionally applied to the inner surface of the viewing faceplate 18 in an aqueous solution containing about 10 percent by weight of propanol and about 10 percent by weight of a water soluble, adhesion promoting polymer such as poly vinyl alcohol, polyacrylic acid, certain polyamides and the like, and the coated solution is dried to form the conductive layer 32 having a thickness from about 1 to 2 microns and a surface resistivity of less than about $10^{8}$ Ω/□(ohms per square unit).

The photoconductive layer 34 is formed by coating the conductive layer 32 with a photoconductive solution comprising a volatilizable organic polymeric material, a suitable photoconductive dye and a solvent. The polymeric material is an organic polymer such as polyvinyl carbazole, or an organic monomer such as n-ethyl carbazole, n-vinyl carbazole or tetraphenylbutatriene dissolved in a polymeric binder such as polymethylmethacrylate or polypropylene carbonate. The suitable dyes, which are sensitive to light in the visible spectrum, preferably from about 400 to 700 nm, include crystal violet, chloridine blue, rhodamine EG and the like. This dye is typically present in the photoconductive composition in from about 0.1 to 0.4% by weight. The solvent for the photoconductive composition is an organic such as chlorobenzene or cyclopentanone and the like which will produce as little cross contamination as possible between the layers 32 and 34. The photoconductive solution is conventionally applied to the conductive layer 32, as by spin coating, and dried to form a layer having a thickness from about 2 to 6 microns.

FIG. 3B schematically illustrates a charging step, wherein the photoconductive layer 34 overlying the conductive layer 32 is positively charged in a dark environment by a conventional positive corona discharger 36, while the conductive layer 32 is negatively charged and grounded. The corona discharger 36 moves across the layer 34 and charges it within the range of +200 to +700 volts.

FIG. 3C schematically shows an exposure step, wherein the charged photoconductor 34 is exposed through the shadow mask 16 to the light from a xenon flash lamp 38 having a lens system 40 in the dark environment. Therefore, the shadow mask 16 is firstly installed on the panel 12 and the conductive layer 32 is grounded. In this step, when the xenon flash lamp 38 sheds light on the photoconductive layer 34 through the lens system 40 and the shadow mask 16, parts of the photoconductive layer 34 corresponding to slots or apertures 16*a* of the shadow mask 16 are exposed to the light, and positive charges at the exposed parts are discharged through the conductive layer 32 by visible rays. Therefore, only the exposed parts remain uncharged as shown in FIG. 3C. Preferably, the xenon flash lamp 38 may have a construction capable of moving among three positions so that the light may coincide with the incident angles of the electron beams as does in the prior art, in order to attach the light-absorptive matrix for a color CRT.

FIG. 3D schematically represents a developing step. In the developing step, dry light absorptive particles or dry phosphor particles and carrier beads are contained in a developing container 42. The carrier beads can generate electrostatic charges when they come into contact with the particles. That is, the carrier beads preferably may charge the dry light absorptive particles negatively and the dry phosphor particles positively when they contact the particles, and the carrier beads are mixed in such a manner that they can perform such triboelectrical charging function. The panel 12 from which the shadow mask 16 is eliminated is disposed on the developing container 42 containing the particles, so that the photoconductive layer 34 can contact the particles.

In this case, the negatively charged dry light absorptive particles are attached to the positively charged unexposed portion of the photoconductive layer 34 by electric attraction, while the positively charged dry phosphor particles are repelled by the positively charged unexposed portion of the photoconductive layer 34 and instead attached on the uncharged exposed portion of the photoconductive layer 34 by the reversal developing phenomenon.

FIG. 3E schematically represents a fixing step by means of infrared heating. In this fixing step, the dry light absorptive particles and dry phosphor particles attached as described above in the developing step are fixed to each other and on the photoconductive layer 34. Therefore, proper polymer components melted by heating are contained in the dry light absorptive particles, the dry phosphor particles, and the photoconductive layer 34.

The above steps shown in FIGS. 3A to 3E are repeated with respect to the three phosphor elements R, G and B, in order to manufacture a color CRT. After an array of three phosphor elements R, G and B and the light-absorptive material are formed through the above process, a lacquer layer and an aluminum thin film are formed according to conventional methods. Thereafter, a baking step is carried out, in which the array and the material are heated and dried for 30 minutes under 425° C. in the atmosphere, so that volatile material such as solvent is eliminated from the conductive layer 32, the photoconductive layer 34, the phosphor elements, and lacquers. Then, obtained is a phosphor surface 20 in which the right-absorptive material 21 and three phosphor elements R, G and B are formed as shown in FIGS. 2A and 2B.

As an alternative to the above-described "matrix first" process, U.S. Pat. No. 5,240,798 issued on Aug. 31, 1993, discloses a "matrix last" process, wherein the black matrix 21 is electrophotographically formed after the fixing of the three phosphor particles R, G and B. In the matrix last process, the photoconductive layer 34 is recharged positively, thereby creating electrostatic "image forces" that are weakest in the areas with overlying phosphor particles and strongest in the open areas between the overlying phosphor particles. Thus, without an exposure step, the black matrix particles can be deposited on the open areas of the photoconductive layer 34 in the developing step due to a large voltage contrast of the charges between the overlying areas and open areas, providing a matrix of greater opacity without performing an exposure step.

In the above conventional wet photolithographic process and dry eletrophotographical process, the width $W_0$ of an electron beam passing hole of the shadow mask 16 is less than one third of the screen pitch SP which means a gap between the adjacent stripes of the same kind phosphor elements, in case of the stripe-type screen as shown in FIG. 2A. In case of the dot-type screen as shown in FIG. 2B, the width $W_0$ of the electron beam passing hole is less than a value estimated by an equation, SW+2(SP−3*SW)/3, wherein SP and SW respectively mean the gap between the adjacent dots of the same kind phosphor elements and the width of a dot.

The reason of the restriction to the width $W_0$ of the electron beam passing hole is as follows. When the width $W_0$ is larger than the above values, since light is utilized in the exposing step in the conventional wet photolithographic process and dry eletrophotographical process, the exposed area formed by the shadow mask in the exposing step is larger than the width SW of a predetermined phosphor element, and thereby the exposures of the respective adjacent phosphor elements to light overlap to each other and the color purity is deteriorated.

Further, the exposing area can be varied to be of less than the width $W_0$ by controlling the quantity of light. This is because the exposing area can be changed largely even according to a small change ΔI of the quantity of light as shown in FIG. 4. In addition, the less the quantity ΔI of light, the larger the change becomes. That is, when ΔI2 is less than ΔI1, ΔS2 is larger than ΔS1, as shown in FIG. 4. Therefore, the control of the exposing area by controlling the quantity of light cannot be employed in the sensitive screen manufacturing process.

In the event, the conventional shadow mask of the CRT requires high electric power in order to elevate the luminance thereof because most, about 80 percent, of the electron beams collide with the shadow mask and thereby exhausted. The conventional shadow mask has further problems including heating of the mask by the electron beams, the doming phenomenon due to the high temperature, and the purity drift phenomenon. Furthermore, the construction between the shadow mask and the frame becomes complicated, for example, separate elements such as bimetal and a support frame must be employed in order to mount the shadow mask on the frame and compensate for a thermal strain. In addition, the electron gun and the deflection yoke cannot help preparing for the higher electric power.

The present invention has been made to overcome the above described problems of the prior art, and accordingly it is an object of the present invention to provide a shadow mask which additionally has a concentrating function and have enlarged election beam passing holes.

It is another object of the present invention to provide a cathode ray tube having the above shadow mask and a method for manufacturing a screen by means of the shadow mask.

Further another object of the present invention is to provide one specific embodiment of the shadow mask according to the present invention.

SUMMARY OF THE INVENTION

In order to achieve the above objects, the present invention provides a shadow mask of a cathode ray tube, the shadow mask comprising:

a first thin metal plate having a plurality of first election beam passing holes formed at the first thin metal plate, the first thin metal plate having a shape corresponding to a shape of a panel, a first direct current voltage being applied to the first thin metal plate; and a second thin metal plate having a plurality of second election beam passing holes formed at the second thin metal plate, the first thin metal plate having a shape corresponding to the shape of the first thin metal plate, the second metal plate being spaced apart from the first metal plate with a distance, the second electron beam passing holes corresponding to and being aligned with the first electron beam passing holes along a central axis of each bundle of electron beams passing through each of the first electron beam passing holes and each of the second electron beam passing holes, a second direct current voltage being applied to the second thin metal plate, the first direct current voltage and the second direct current voltage concentrating the electron beams in the first electron beam passing holes and the second electron beam passing holes.

Preferably, the shadow mask further comprise a dielectric layer disposed between the first thin metal plate and the second thin metal plate.

The first electron beam passing holes and the second electron beam passing holes may be slots respectively having a width larger than one third of a screen pitch when the cathode ray tube has a stripe-type screen, or they may be apertures respectively having a width larger than a value obtained by an equation, SW+2(SP−3*SW)/3, when the cathode ray tube has a dot-type screen.

The present invention further provides a method for manufacturing a screen of a cathode ray tube, said method comprising the steps of:

(1) coating a volatile conductive layer and a volatile photoconductive layer on an inner surface of a panel in order;

(2) charging electrostatic charges uniformly on the volatile photoconductive layer;

(3) exposing the volatile photoconductive layer to light through a shadow mask so as to selectively discharging the electrostatic charges from the volatile photoconductive layer, thereby forming a latent electric charge image having a predetermined array; and (4) developing the photoconductive layer by attaching charged particles onto one of an exposed area and an unexposed area of the photoconductive layer with controlling a size of a developed area by controlling time, the electrostatic charges being selectively discharged from the exposed area in step 3.

In the method, more preferably, the developing time is controlled so that the developed area has a width smaller than one third of the screen pitch when the charged particles used in step 4 are phosphor particles, or that the developed area has a width smaller than the value obtained by the equation, SW+2(SP−3*SW)/3, when the charged particles used in step 4 are phosphor particles.

DETAILED DESCRIPTION OF THE PREFERRED EMBODIMENT

Figure 1:
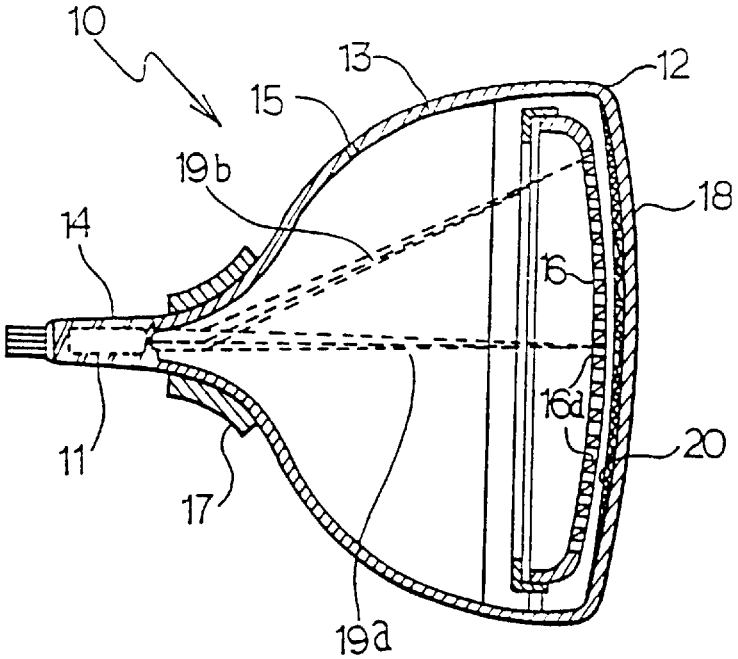
FIG. 1 is a side section of a color cathode ray tube.
Figure 2A:
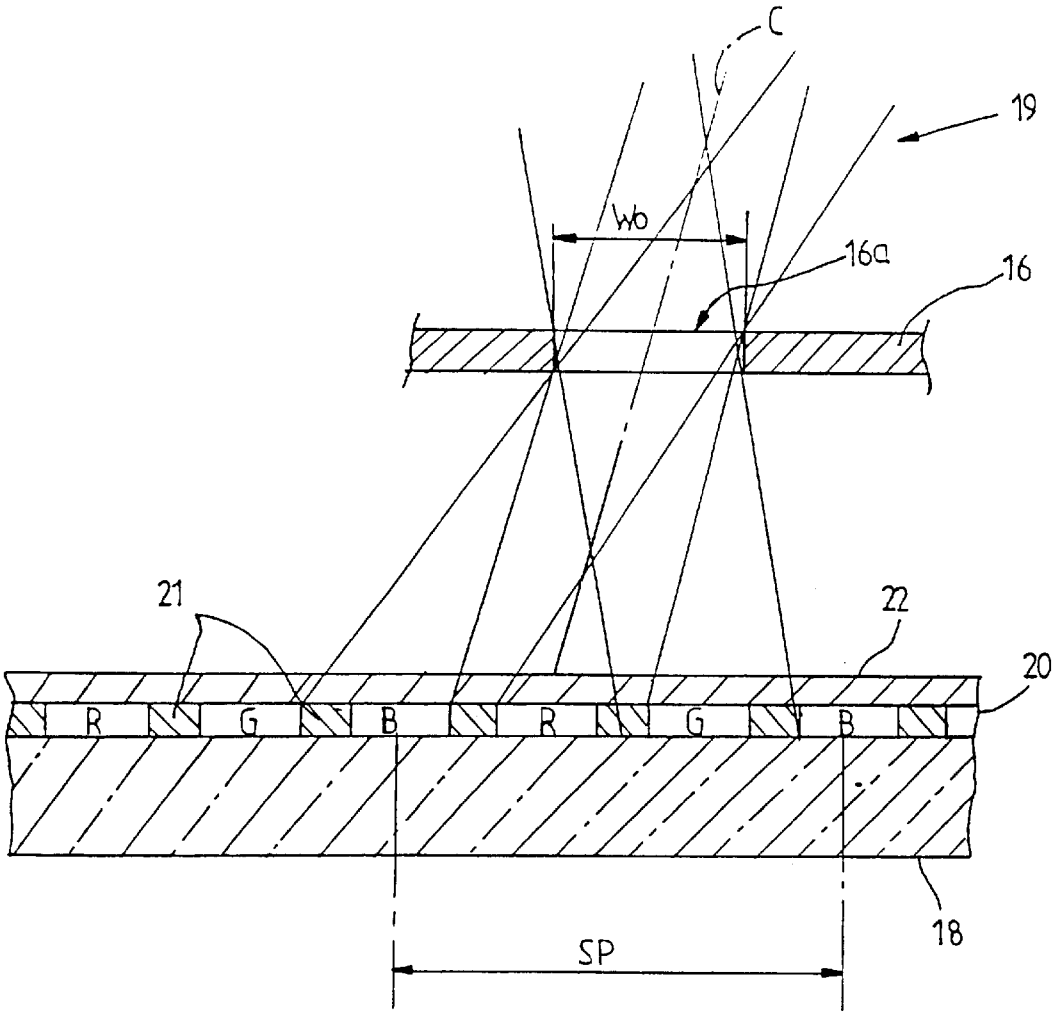
FIGS. 2A and 2B are respectively an enlarged section of a stripe-type screen and an enlarged plan view of a dot-type screen.
Figure 2B:
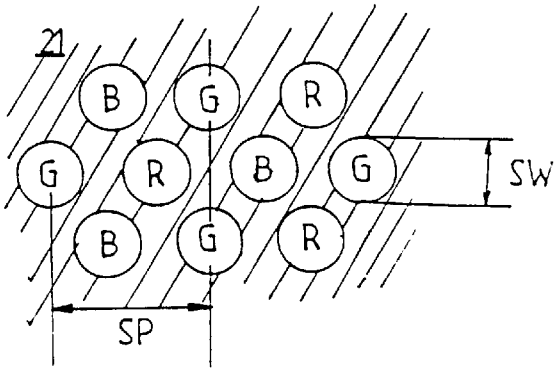

Hereinafter, preferred embodiments of the present invention will be described in detail with reference to the accompanying drawings, in which the same reference numerals will be given to the same elements throughout the drawings.

Figure 5:
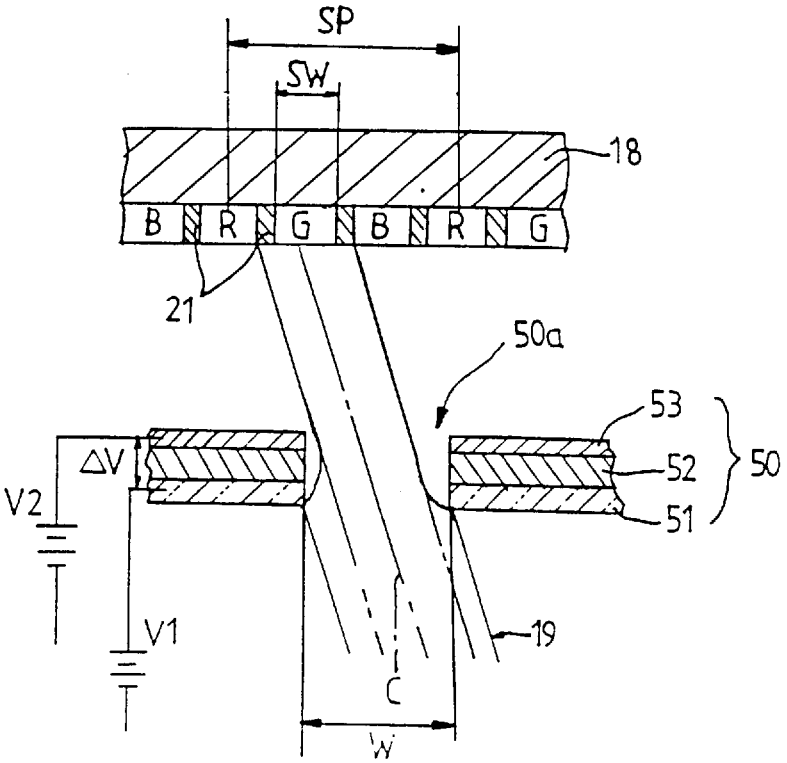
FIG. 5 is an enlarged section of a stripe-type screen, which is for showing the construction and the operation of a shadow mask having a triple construction, according to an embodiment of the present invention.

FIG. 5 is an enlarged section of a stripe-type screen according to an embodiment of the present invention, which has a triple construction of a first thin metal plate 51, a dielectric layer 52, and a second thin metal plate 53.

The shadow mask 50 has a shape nearly equal to that of the faceplate 18 of the cathode ray tube in total. The shadow mask 50 has a plurality of electron passing holes 50*a* for passing the electron beams therethrough, which respectively have a shape of a slot or an aperture.

In case of the stripe type screen, each electron beam passing hole 50*a* has a width W larger than one third of the screen pitch SP, while in case of the dot-type screen, the width W of each electron beam passing hole 50*a* is larger than a value estimated by an equation, SW+2(SP−3*SW)/3. In the following description, the shadow mask having the electron beam passing hole of a width larger than the above values as defined in this paragraph will be named as a high-luminance-low-temperature shadow mask.

Further, a first direct current voltage V1 and a second direct current voltage V2 are applied to the first and the third thin metal plates 51 and 53 so that the electron beams 19 passing through the large election beam passing hole 50*a* is concentrated on the screen with a size smaller than one third of the screen pitch SP or the value estimated by the equation, SW+2(SP−3*SW)/3.

The degree of the concentration of the electron beams 19 depends on the electric potential difference ΔV between the first and the second direct current voltages V1 and V2, the magnitude of the anode voltage, and the thickness of the high-luminance-low-temperature shadow mask 50.

The dielectric layer 52 between the first and the third thin metal plates 51 and the 53 is filled with dielectric material, which is preferably an inorganic material so as to prevent generation of organic gas. The dielectric layer 52 may be formed with an empty gap as circumstances require.

FIGS. 6A through 8C show a developing step of a method for manufacturing a screen by means of the high-luminance-low-temperature shadow mask 50, while the coating, exposing, and fixing steps of the method are the same as in the prior art and omitted herein.

Figures 3A, 3B, 3C, 3D, 3E:
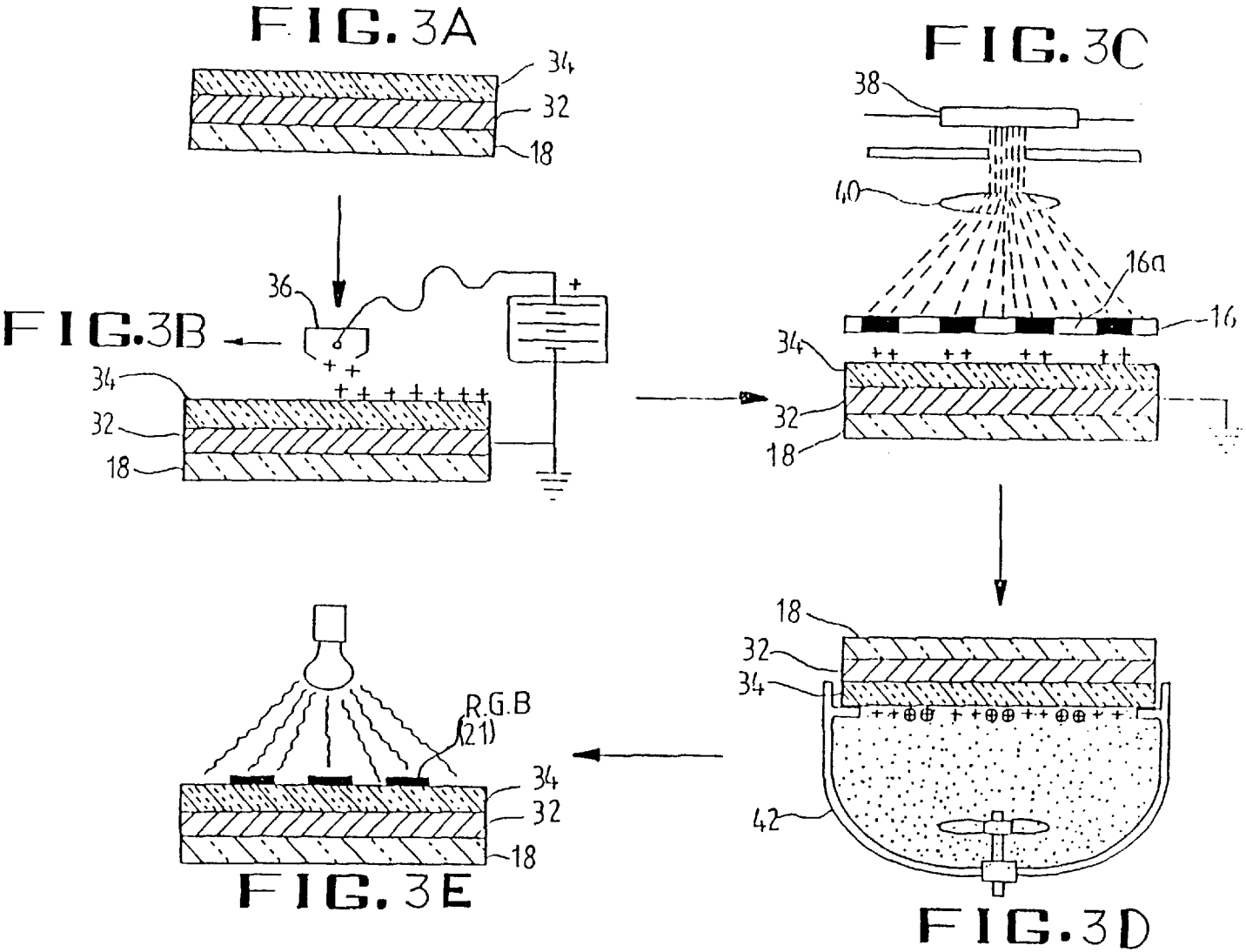
FIGS. 3A through 3E show a conventional dry-type method of electrophotographically manufacturing the phosphor screen assembly.
Figure 4:
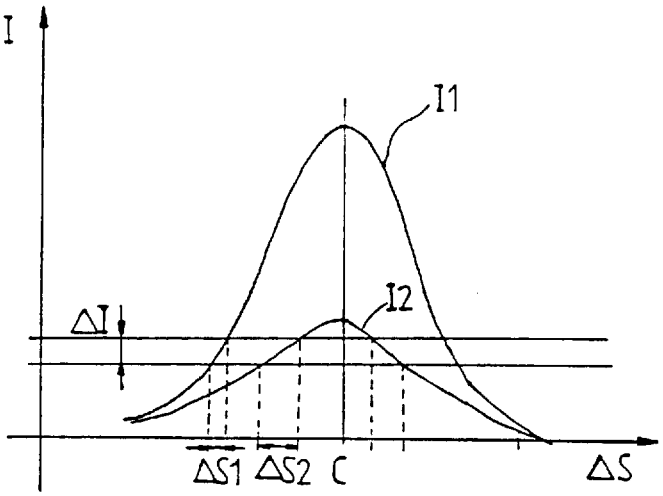
FIG. 4 is a graph for showing the relation between the intensity of the light and the exposing area in the exposing step.

Referring again to FIG. 3, the volatile conductive layer 32 and volatile photoconductive layer 34 are formed at the inner surface of the faceplate 18 in the coating step, and the volatile photoconductive layer 34 is uniformly charged with predetermined electrostatic charges by the corona discharger 36 in the charging step. In the exposing step, the photoconductive layer 34 is exposed to light through the high-luminance-low-temperature shadow mask 50 according to the present invention, so as to have an array of latent charge image formed therein which is shown in FIGS. 6A through 6C.

Figure 6A:
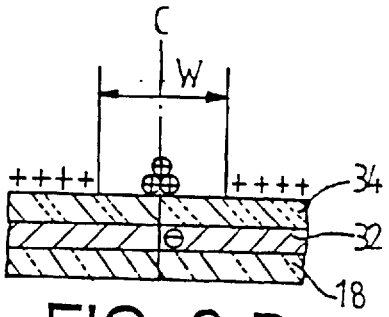
FIGS. 6A through 6C are enlarged partial sections of the screen shown in FIG. 5, which show a method for manufacturing the screen according to the present invention.
Figure 6B:
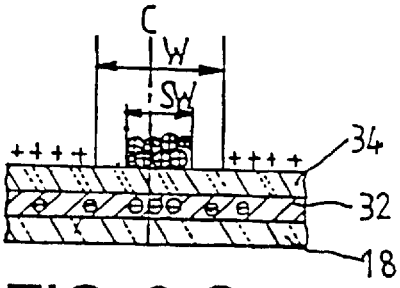
Figure 6C:
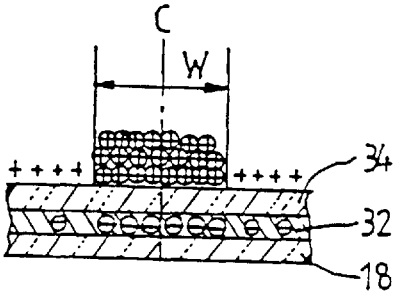
Figure 7A:
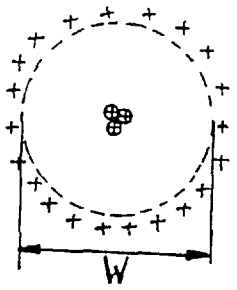
FIGS. 7A through 7C show electric charges formed on the screen in the method shown in FIGS. 6A through 6C.
Figure 7B:
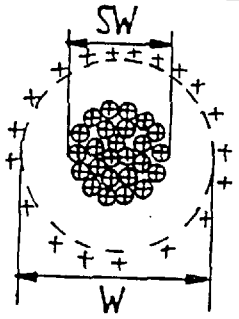
Figure 7C:
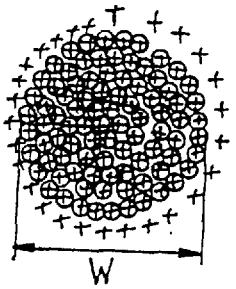
Figure 8A:
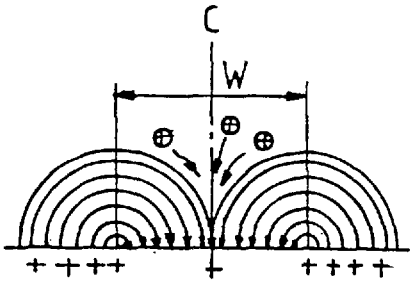
FIGS. 8A through 8C show the change of the equipotential distribution on the screen according to the progress of time in the developing step of the method shown in FIGS. 6A through 6C.
Figure 8B:
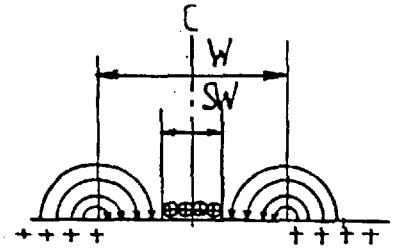
Figure 8C:
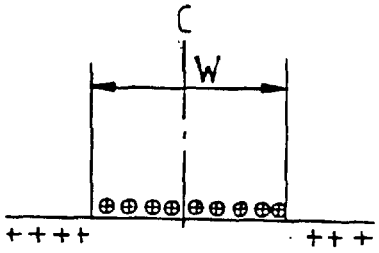

FIGS. 6A through 6C show the attached states of the phosphor elements according to the progress of time in the developing step. FIGS. 7A through 7C show electric charges formed on the screen corresponding to FIGS. 6A through 6C. FIGS. 8A through 8C show the change of the equipotential distribution on the screen according to the progress of time in the developing step of the method shown in FIGS. 6A through 6C.

In FIGS. 6A to 7C, W means the width of the exposed area which is equal to the width W of the electron beam passing hole 50*a* of the high-luminance-low-temperature shadow mask 50 in FIG. 5 due to the straightness of light in the exposing step.

FIG. 6A shows an initial stage of the developing step which has an electric field distribution shown in FIG. 8A, wherein the phosphor particles charged with floating and approaching electrostatic charges are attracted by the electric attraction and repulsion, so as to be attached onto the 34 near the central axis C of the 34 at which the electric field is intensest.

According to the passage of time, the area to which the charged phosphor particles are attached is gradually widened from the central axis C as shown in FIG. 6B, and at last the exposed area is subjected to the development along the entire width W thereof as shown in FIGS. 6C and 7C. Then, nearly no electric field is distributed on the 34 as shown in FIG. 8C, and thereby it is difficult for the floating and approaching electrostatic charges to be attached thereon any more.

As described above, the present invention pays attention to the degree of the development and the distribution of the electric field on the 34 according to the passage of time. That is, the development is carried out until a predetermined area is developed, so as to manufacture an array construction of a screen in which the width SW of a phosphor element is less than one third of the screen pitch SP or the value estimated by the equation, SW+2(SP−3*SW)/3.

Accordingly, the present invention prevents the exposures of the adjacent phosphor elements to light from overlapping with each other, even in case where the screen is manufactured using a shadow mask having enlarged electron beam passing holes.

In usual, such control of the developing area is enabled by controlling time. However, the degree of the development or the developing area can be controlled by means of measurement of the electric field as shown in FIGS. 8A to 8C depending on circumstances.

In the developing step, the floating and approaching phosphor particles may be sprayed in a wet slurry state by the conventional electrostatic applying method. Otherwise, the phosphor particles may be dry phosphor fine particles in the recent dry eletrophotographical screen manufacturing method. Further, in order to a color CRT, the phosphor particles may be one of the first to third phosphor particles, and the charging, exposing, and developing steps may be repeated so that the one phosphor particles may form a predetermined array with respect to the other phosphor particles.

The operation and function of the high-luminance-low-temperature shadow mask 50 and the screen using the filter according to the present invention as described above will be described hereinafter.

Referring to FIG. 5, the electron beams 19 pass through the electron beam passing hole 50*a* of the high-luminance-low-temperature shadow mask 50 with a width equal to the width W of the electron beam passing hole 50*a*. In this case, the electron beams 19 scan over the screen in a state that the width of the electron beams 19 is concentrated to a size less than one third of the screen pitch SP or the value estimated by the equation, SW+2(SP−3*SW)/3due to the electric potential difference ΔV between the first and the third thin metal plates 51 and the 53.

Therefore, a small quantity of electron beams collide with the high-luminance-low-temperature shadow mask while a large quantity of electron beams pass through the electron beam passing hole, and thereby the luminance can be largely heightened even with low electric power without deteriorating the purity of colors. Further, since the shadow mask is not heated much, the doming phenomenon and the purity drift phenomenon due to heat deformation are prevented, and no bimetal is required in the frame assembly.

Moreover, the present invention enables the frame to be light since the frame does not need to have great heat capacity. Accordingly, the heater and the cathode can be operated under low temperature and by low electric power, and the constructions of the electron gun and the deflection yoke can be simplified.

Figure 9:
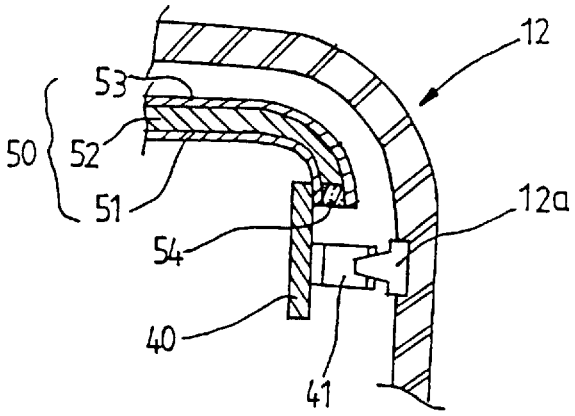
FIG. 9 is a partial sectional view showing one specific embodiment of the shadow mask for applying different positive voltages to two first and the second thin metal plates according to a more particular aspect of the invention.

FIG. 9 shows one specific embodiment of the shadow mask for applying different positive voltages to two first and the second thin metal plates according to a more particular aspect of the invention as a partial sectional view.

In FIG. 9, an assembly of a shadow mask 50 and a support frame 40 of the shadow mask 50 is detachably supported at stud pins 12*a* integral with a panel 12 of a CRT by means of holders 41 integral with the assembly.

As described hereinbefore, the shadow mask 50 comprises the first thin metal plate 51, the second thin metal plate 53, the dielectric layer 52 filled in therebetween and a resistor body 54 electrically connected between the first and the second thin metal plates 51, 53 at peripheral ends thereof. A resistor value of the resistor body 54 is determined by the voltage difference value ΔV in FIG. 5.

By the simple construction of FIG. 9 using the resistor body 54, the voltage difference for focusing the election beams 19 can be easily obtained between the first and the second thin metal plates 51, 53.

That is, an anode positive voltage may be applied as the first D.C. voltage to the first thin metal plate 51 from an anode 15(see FIG. 1) through a conductive DAG layer, applied to an inside surface of the panel 12, the stud pins 12*a*, the holders 41 and the frame 40. The anode positive voltage or the first D.C. voltage V1 applied to the first thin metal plate 51 passes through the resistor body 54 and drops by the voltage difference B4V to the second D.C. voltage V2, which is applied to the second thin metal plates 53.

Thus, as shown in FIG. 5, the electron beams 19 are focussed by the voltage difference B4V while passing through the apertures or slits 50*a* of the shadow mask 50.

Said resistor body 54 is preferably secured to the peripheral end of the first and the second thin metal plates 51, 53, but may be fixedly secured to the frame 40 at one end of the resistor body 54 with other one end of the resistor body 54 being electrically connected to the second thin metal plate 53.

The specific simple construction of the shadow mask 50 shown in FIG. 9 facilitates the easy application of the different positive voltages V1, V2 to the first and the second thin metal plates 51, 53 using only one higher positive voltage or an anode voltage with no application of the lower positive voltage, thereby necessitating no other electric connection.

By using several resistor bodies 54 with a uniform thickness as shown in FIG. 9, the first thin metal plates 51 and the second thin metal plate 53 can be fixedly assembled with a uniform gap therebetween(not shown), thus such a uniform gap forms a vacuum dielectric layer without any dielectric substance.

While the present invention has been particularly shown and described with reference to the particular embodiments thereof, it will be understood by those skilled in the art that various changes in form and details may be effected therein without departing from the spirit and scope of the invention as defined by the appended claims.

What is claimed is:

1. A method of manufacturing a screen for a cathode ray tube, said method comprising the steps of:

(1) coating a volatile conductive layer and a volatile photoconductive layer on an inner surface of a panel in order;

(2) charging electrostatic charges uniformly on the volatile photoconductive layer;

(3) exposing the volatile photoconductive layer to light through a shadow mask so as to selectively discharge the electrostatic charges from the volatile photoconductive photoconductive layer, thereby forming a latent electric charge image of a predetermined array; and (4) developing the photoconductive layer by attaching charges particles onto one of an exposed area and an unexposed area of the photoconductive layer with controlling a size of a developed area by controlling time;

wherein the shadow mask used in step 3 comprises a first thin metal plate and a second thin-metal plate, the first thin metal plate having a plurality of first electron beam passing holes, the first thin metal plate having a shape corresponding to a shape of a panel in a manner to be spaced apart from the first metal plate with a uniform gap, a first direct current voltage being applied to the first thin metal plate, a second thin metal plate having a plurality of second electron beam passing holes, the first thin metal plate having a shape corresponding to the shape of the first thin metal plate, the second metal plate being spaced apart from the first metal plate with a uniform gap, the second electron beam passing holes corresponding to and being coaxially aligned with the first electron beam passing holes, a second thin metal plate for the electron beam.

2. A method as claimed in claim 1, wherein the shadow mask used in step 3 comprises a plurality of apertures respectively having a width larger than a value obtained by an equation, SW+2(SP−3*SW)/3, when the cathode ray tube has a dot-type screen, and the developed area has a width smaller than the value obtained by the equation, SW+2(SP−3*SW)/3, when the charged particles used in step 4 are phosphor particles.

3. A method as claimed in claim 1, wherein the charged particles used in step 4 are one of first, second, and third phosphor particles, and steps 2, 3, and 4 are repeated so that remaining elements of the first, the second and the third phosphor particles may from a predetermined array.

4. A method as claimed in claim 3, wherein the charged particles are in a wet slurry state and sprayed by an electrostatic applying method.

5. A method as claimed in claim 3, wherein the charged particles are dry fine particles.

* * * * *